United States Patent [19]

Flaum et al.

[11] 4,316,428

[45] Feb. 23, 1982

[54] FLUID METERING DEVICE

[75] Inventors: Stephen S. Flaum, Brooklyn; Jozef Z. Zielinski, Flushing, both of N.Y.

[73] Assignee: S&S Corrugated Paper Machinery Co., Inc., Brooklyn, N.Y.

[21] Appl. No.: 211,832

[22] Filed: Dec. 1, 1980

[51] Int. Cl.[3] ..... B05C 1/08

[52] U.S. Cl. ..... 118/203; 118/259; 118/261; 101/366; 101/425

[58] Field of Search ..... 118/259, 258, 203, 262, 118/261; 101/366, 425

[56] References Cited

U.S. PATENT DOCUMENTS

| | | | |
|---|---|---|---|
| 3,418,970 | 12/1968 | Phelps et al. | 118/410 |
| 3,980,043 | 9/1976 | Pomper | 118/259 X |
| 4,223,633 | 9/1980 | Alvensleben et al. | 118/203 |

*Primary Examiner*—John P. McIntosh

*Attorney, Agent, or Firm*—Ostrolenk, Faber, Gerb & Soffen

[57] ABSTRACT

A single facer is provided with an adjustable width glue means including an elongated floating shoe having doctor blade means biased toward a glue applicator roll and movable away from the latter to form a metering gap through which glue exits from an elongated fluid cavity of the shoe as a thin film on the applicator roll. The shoe also includes an elongated fluid manifold which receives glue under pressure from a glue supply. A plurality of passages formed in the shoe and spaced along the length thereof interconnect the fluid cavity and manifold so that glue flows to the former from the latter. Longitudinally adjustable side dams are provided for the cavity and manifold to control the width of the glue film. A cleaning fluid introduced at the ends of the manifold flushes through those passages outboard of the dams and exits at the ends of the cavity to prevent build-up of glue in the shoe.

10 Claims, 2 Drawing Figures

FLUID METERING DEVICE

In general this invention relates to means for producing a wide glue film of controlled thickness and more particularly relates to means for adjusting the width of the glue film.

Copending U.S. application Ser. No. 22,141 filed Mar. 20, 1979, now abandoned, for An Adhesive Metering Device, with S. S. Flaum and M. J. Leff as coinventors, and assigned to the assignee of the instant invention, discloses means for producing a thin wide film of glue on a rotating glue applicator roll by utilizing an elongated shoe floatingly mounted adjacent the applicator roll. The shoe is provided with a longitudinally extending cavity which confronts the applicator roll and into which glue is pumped at a controlled rate. Glue leaves the cavity through a narrow metering gap along the downstream edge of the shoe.

In order to utilize this type of glue means for apparatus which produces single face corrugated board it is necessary to provide means for controlling the width of the glue film. That is, the glue film must be wide enough so that is covers the entire length of each flute tip yet it cannot be wider than the corrugated layer because the excess width of the glue film would be applied to the corrugating roll and harden thereon, hardened glue being particularly difficult and time consuming to remove.

It has been found that with apparatus of the type described in the aforesaid copending Application Ser. No. 22,141, in order to obtain uniform thickness throughout the width of the glue film it is advantageous to introduce glue at a plurality of points spaced along the length of the cavity. To adjust film width, movable dams are provided at opposite ends of the cavity, and in order to prevent glue from hardening outboard of these dams, the instant invention provides means for flushing those passages which are provided for supplying glue to those portions of the cavity which lie outboard of the movable dams.

Accordingly, a primary object of the instant invention is to provide novel means for controlling the width of a glue film produced by a so-called squeeze-type glue means.

Still another object is to provide a glue applicator having novel means for flushing those glue passages that are not being used for carrying glue to a glue cavity partially bounded by the peripheral surface of a glue applicator roll.

These objects as well as other objects of this invention shall become readily apparent after reading the following description of the accompanying drawings in which.

Figure 1:
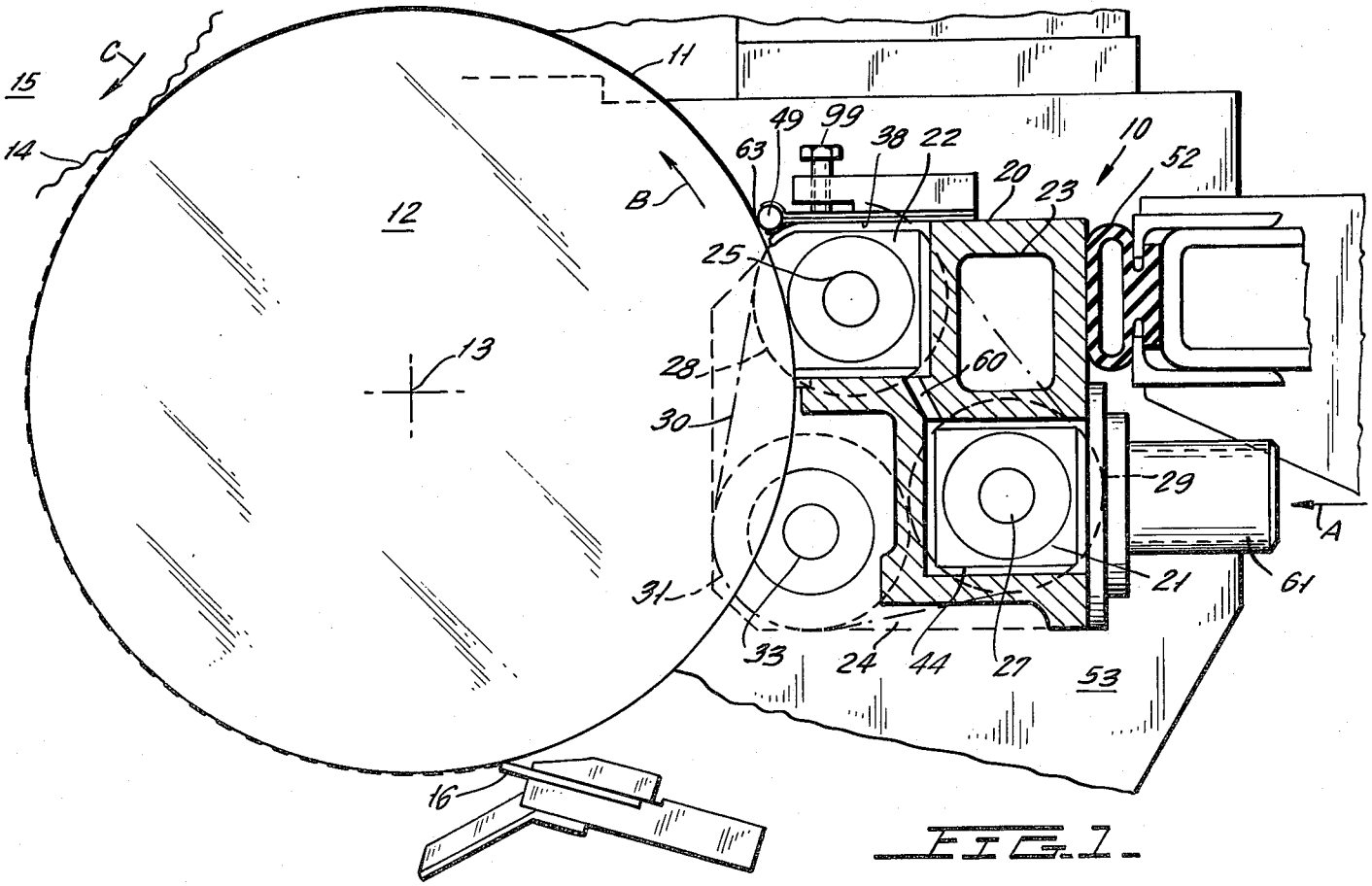
FIG. 1 is a transverse cross-section taken through apparatus constructed in accordance with teachings of the instant invention for producing a glue film and applying same to the flute tips of a corrugated layer.

Now referring to the Figures keeping in mind that the disclosure of the aforesaid copending Application Ser. No. 22,141 filed Mar. 20, 1979 is incorporated herein by reference.

Metering means 10 constructed in accordance with teachings of the instant invention forms a thin flue film 11 on the periphery of glue applicator roll 12 as it rotates about center 13 in the direction indicated by arrow B. Upstream of metering means 10, flue film 11 is applied to the flute tips of transversely corrugated web 14 while the latter is supported by corrugating roll 15 rotating in the direction indicated by arrow C. Scraper blade 16 disposed adjacent the outer surface of roll 12 at a position downstream of corrugating roll 15 removes that portion of glue film 11 which is not applied to corrugated web 14.

Metering means 10 includes elongated extruded metal shoe 20 which extends parallel to axis 13 and confronts applicator 12 along the length thereof. Extending lengthwise through shoe 20 are glue manifold 21, glue cavity 22 and water passage 23. The periphery of roll 12 provides the left boundary for glue cavity 22 as viewed in FIG. 1. An individual cap 24 closes each end of shoe 20. Individual bearings 26 mounted to each of the caps 24, 24 rotatably support lead screw 25 at opposite ends thereof. Screw 25 extends longitudinally through glue cavity 22. In a similar manner lead screw 27 extends longitudinally through glue manifold 21 and at its ends is rotatably supported by bearings mounted to end caps 24, 24. Sprockets 28, 29 are mounted to the ends of the respective lead screws 25, 27 in driving relationship therewith. Closed loop chain 30 is wrapped around sprockets 28, 29 as well as around drive sprocket 31. The latter is keyed to shaft 33 which is rotatably supported by bearing 34 mounted to end cap 24. Thus, when shaft 33 is rotated to rotate sprocket 31, chain 30 drives sprockets 28, 29 to rotate lead screws 25, 27.

Lead screw 25 is in threaded engagement with nut 36 to which generally rectangular dam 37 is secured. The edge of dam 37 is provided with seal 38, three sides of which are in sealing engagement with the inner surface defining glue cavity 22. The fourth side of seal 38 abuts the outer surface of applicator roll 12. Mounted on the other end of screw 25 is another assembly similar to nut 36, dam 37, and seal 38. It is noted that the thread at the end of the screw 25 not shown in FIG. 2 is the reverse of that thread shown in FIG. 2 so that upon rotation of the screw 25 the dams 37, 37 driven by lead screw 25 move in opposite directions.

Figure 2:
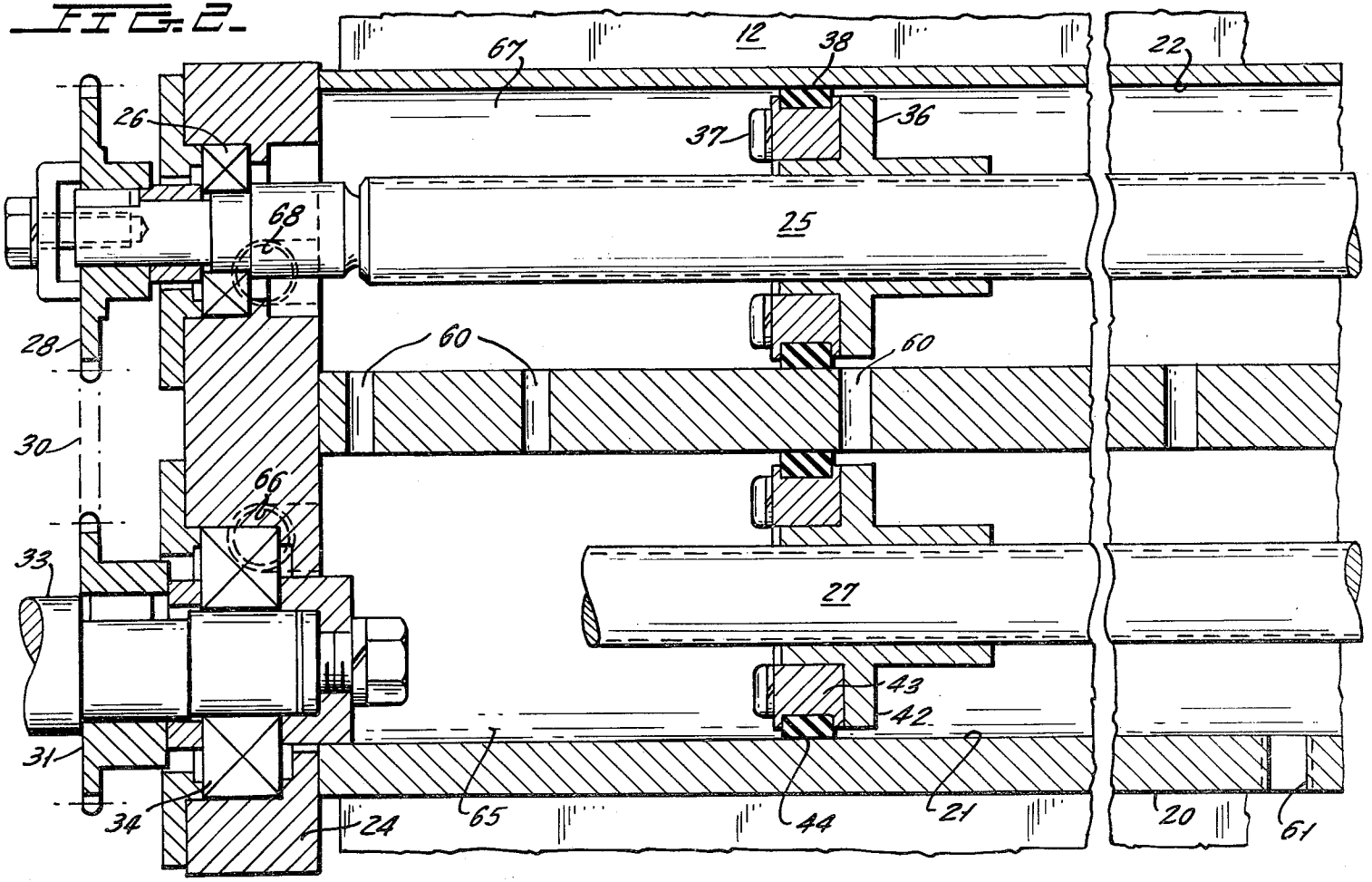
FIG. 2 is a fragmentary longitudinal cross-section of the apparatus of FIG. 1 looking in the direction of arrow A of FIG. 1.

In a similar manner the threads at opposite ends of lead screw 27 are spiraled in opposite directions and are threadably engaged with two nuts 42, only one of which is shown in FIG. 2. Each nut 42 is connected to a rectangular dam 43 whose edge is surrounded by seal 44 in engagement with the inner surface defining glue manifold 21. Seals 44, 44 are in general transverse alignment with seals 38, 38.

The downstream edge of glue cavity 22 is provided with rod-like doctor blade 49 which is biased toward the periphery of applicator roll 12 by fluid pressure within an expandable gland or jacket 52 mounted to stationary frame 53. Shaft 33 provides a stationary pivot supporting the left end of shoe 20 for limited pivotal movement with respect to frame 53. The other end of shoe 20 is pivotally supported on frame 53 by a shaft extension (not shown) in axial alignment with shaft 33. Thus, as pressurized fluid is introduced into gland 52 shoe 20 is urged to pivot about the center of shaft 33 and doctor blade 49 is urged toward the periphery of applicator roll 12. Adjustable stop 99 is provided to maintain doctoring rod 49 parallel to the outer surface of roll 12 so that, throughout its length, metering gap 63 is of uniform width.

A plurality of transverse passages 60 within shoe 20 interconnect glue manifold 21 with glue cavity 22. Glue is introduced into manifold 21 through a plurality of inlet openings 61, only one of which is shown in FIG. 2. In a typical 97 inch wide single facer, passages 60 are spaced by approximately 2 inches, and inlet openings 61 are disposed more inward than the most inward positions for seals 38, 38.

In operation, glue under pressure and flowing at a known uniform rate enters manifold 21 through openings 61. Glue fills manifold 21 between end dams 43, 43 and flows through passages 60 into glue cavity 22. Glue fills cavity 22 between dams 37, 37 and is forced through metering gap 63 between doctor blade 49 and the periphery of applicator roll 12 to form glue film 11. Glue flows from manifold 21 to cavity 22 only through those passages 60 positioned between seals 44, 44 and 38, 38. The width of glue film 11 is equal to the spacing between seals 38.

The width of glue film 11 on roll 12 is adjusted by rotating shaft 33 in the appropriate direction to move dam 37, 37 and 43, 43 toward or away from one another as required. To clean glue from those passages 60 outboard of seals 38, 38 and 44, 44, water is introduced into the end portions 65 of manifold 21 through right angle passages 66, 66 in end caps 24, 24. This water flows through those passages 60 outboard of seals 44, 44 and flushes glue therefrom as well as cleaning manifold portions 65, 65. The water then flows into end portions 67 of cavity 22 positioned outboard of seals 38, 38 and then leaves shoe 20 through L-shaped passages 68, 68 in end caps 24, 24.

The washing cycle (injection of water at inlet 66) is relatively short and may take place while glue is being fed into manifold 21, so that there is no need to interrupt production during wash-up.

To control glue temperature, fluid at a selected temperature may be circulated through passage 23.

While lead screws 25, 27 have been shown as the means for adjusting dams 37, 43, it should now be apparent to those skilled in the art that other means, such as cables, may be used to adjust dams 37, 43.

Although a preferred embodiment of this invention has been described, many variations and modifications will now be apparent to those skilled in the art, and it is therefore preferred that the instant invention be limited not by the specific disclosure herein, but only by the appending claims.

What is claimed is:

1. Fluid metering means including a fluid carrying cylinder for applying a fluid film to an element moving relative to said cylinder; said fluid carrying cylinder being mounted for rotation on its relatively stationary cylindrical axis; shoe means extending parallel to said cylindrical axis; said fluid carrying cylinder having an outer cylindrical surface and said shoe means having a side confronting a portion of said cylindrical surface; an elongated fluid cavity extending generally parallel to said cylindrical axis; said fluid cavity being formed by a depression in said side of said shoe means and being partially bounded by a portion of said cylindrical surface; and elongated fluid distribution slot partially bounded by said cylindrical surface and positioned along the downstream edge of said fluid cavity; means movably mounting said shoe means to permit said fluid distribution slot to vary in thickness; biasing means urging said fluid distribution slot to close; an elongated fluid manifold; means defining a plurality of passages connecting said cavity with said manifold; said passages being distributed along the length of said cavity and constituting fluid outlet means for said manifold; first means including spaced end dam elements disposed in said cavity and mounted for movement between positions near the ends thereof and selected positions inboard thereof; second means including spaced end dam elements disposed in said manifold and mounted for movement between positions near the ends thereof and selected positions inboard thereof in relation to movement of the dam elements of said first means; the dam elements of said first and said second means being positionable inboard of some of said passages; said manifold having fluid inlet means at a central region thereof disposed inboard of the elements of said second means; said inlet means being operatively connected to receive fluid from a fluid supply means, which fluid flows through said manifold to said cavity through those of said passages positioned inboard of the elements of said first means and flows from said cavity through said slot to form a fluid film on said cylinder having a width equal substantially to the spacing between the elements of said first means.

2. Fluid metering means as set forth in claim 1 in which the manifold is integral with said shoe means and extends legthwise thereof; said passages extending through a wall section of said shoe means separating said cavity and said manifold.

3. Fluid metering means as set forth in claim 1 also including first drive means for moving said dam elements of said first means; second drive means for moving said dam elements of said second means; connecting means connecting said first and second drive means for coordinated operation thereof.

4. Fluid metering means as set forth in claim 3 in which the first drive means simultaneously moves the dam elements of the first means in opposite directions and the second drive means simultaneously moves the dam elements of the second means in opposite directions.

5. Fluid metering means as set forth in claim 3 in which the dam elements of the first means are in general alignment with the dam elements of the second means.

6. Fluid metering means as set forth in claim 5 in which the first and second drive means include lead screw means connected for simultaneous operation.

7. Fluid metering means as set forth in claim 3 also including fitting means for introducing a flushing liquid into one of said cavity and said manifold, which liquid flows through those of said passages outboard of said dam elements of said first and second means and then flows through the other of said cavity and said manifold.

8. Fluid metering means as set forth in claim 6 in which the passages extend through a wall section of said shoe means separating said cavity and said manifold.

9. Fluid metering means as set forth in claim 1 also including fitting means at the ends of the shoe means for introducing a flushing liquid into one of said cavity and said manifold, which liquid, flows through those of said passages outboard of said dam elements of said first and second means and then flows through the other of said cavity and said manifold.

10. Fluid metering means as set forth in claim 9 in which the passages extend through a wall section of said shoe means separating said cavity and said manifold.

* * * * *